United States Patent [19]

Holmen

[11] 4,373,332

[45] Feb. 15, 1983

[54] MOVEMENT COMPENSATION ARRANGEMENT

[75] Inventor: Hans K. Holmen, Sandvika, Norway

[73] Assignee: A/S Tele-Plan, Lysaker, Norway

[21] Appl. No.: 114,774

[22] Filed: Jan. 23, 1980

[30] Foreign Application Priority Data

Jan. 31, 1979 [NO] Norway ..... 790311
Apr. 24, 1979 [NO] Norway ..... 791356

[51] Int. Cl.[3] ..... F15B 9/17

[52] U.S. Cl. ..... 60/426; 60/416; 60/420; 254/291

[58] Field of Search ..... 60/375, 381, 423, 426, 60/420, 416; 254/291, 273, 277, 900; 414/138

[56] References Cited

U.S. PATENT DOCUMENTS

| | | | |
|---|---|---|---|
| 2,811,838 | 11/1967 | Lindsey | 60/381 X |
| 3,443,379 | 5/1969 | Weisenbach | 60/426 |
| 3,576,106 | 4/1971 | Nowicki | 60/426 |
| 3,738,110 | 6/1973 | Grosseau | 60/390 X |
| 3,965,841 | 6/1976 | Croese | 254/291 X |
| 4,098,144 | 7/1978 | Besel et al. | 60/416 X |
| 4,121,806 | 10/1978 | Iato et al. | 254/277 X |

FOREIGN PATENT DOCUMENTS

| | | |
|---|---|---|
| 2264759 | 10/1975 | France . |
| 2314886 | 1/1977 | France . |
| 1339131 | 11/1973 | United Kingdom . |

*Primary Examiner*—Gerald A. Michalsky

*Attorney, Agent, or Firm*—Ladas & Parry

[57] ABSTRACT

This movement compensation arrangement in one aspect comprises a hydraulic main motor group driven by the pressure difference between two hydropneumatic pressure containers and a hydraulic auxiliary motor group driven by a pump with an effect which can be regulated, and adapted to provide for dynamic compensation. The hydraulic main motor group is adapted to substantially take up the static load. The two motor groups are rotationally coupled to moving means. A control unit in response to input signals controls both motor groups, of which the main motor group has a stepwise and/or continuously variable displacement (FIG. 1).

In another and modified aspect the arrangement comprises a hydraulic motor group also driven by the pressure difference between two hydropneumatic pressure containers and a hydraulic pump having a power output which is able to be regulated and being adapted to provide for dynamic compensation by actuating a hydraulic-mechanical converting unit which moves an element in a movement compensated system. The hydraulic motor group is adapted mainly to take up static load as the axle from the motor group is directly in a mechanical way or indirectly in a hydraulic-mechanical way, coupled to said element. A control unit in response to input signals controls the hydraulic pump and the motor group. The motor group has a stepwise and/or continuously variable displacement (FIG. 2).

12 Claims, 3 Drawing Figures

MOVEMENT COMPENSATION ARRANGEMENT

This invention relates to a movement compensation means for use with hoisting cranes, mooring equipment or the like, in particular for the purpose of marine or offshore conconditions, under which the control of the movement and position, respectively, of large masses or loads, may give rise to undesirable movements because of disturbing forces, for example caused by waves and swells. When for example a large load shall be transferred to a floating or stationary installation by means of a ship-borne hoisting crane, the undesired movements caused by the waves may seriously damage the base or support on which the load shall be placed, or the load itself may be of such a nature that it may be damaged. Another example of a situation in which wave movements may involve undesirable movement components, is during oil drilling from a floating platform. Means for movement compensation are also necessary on such floating drill rigs or platforms. The invention is not restricted, however, to the use at sea or in offshore operations, but may be employed in all situations where during the control of large masses or loads there may be induced undesired movements because of disturbing forces.

In British patent specification No. 1,339,131 there is described an arrangement for compensating undesired relative movements during the transfer of a load. The arrangement proposed therein comprises a hydraulic motor group driven by the pressure difference between two hydropneumatic container arrangements. A control system serves to control the motor group in such a way that it provides for the dynamic compensation.

The above previously proposed arrangement does not work satisfactorily, which inter alia is due to the specific form of control which is employed, and besides it includes several very expensive components, in particular pressure containers of large capacity and associated compressor and valve systems. It is an object of the present invention to provide a solution having an improved function as well as being more simple and inexpensive than the above and other previously proposed compensation arrangements for the purposes mentioned in the introductory statements above.

On the basis of a movement compensation arrangement comprising a hydraulic main motor group driven by the pressure difference between two hydropneumatic pressure containers, the novel and specific features according to one aspect of the present invention primarily consist therein that the arrangement has a hydraulic auxiliary motor group driven by a pump having an output which can be regulated, and adapted to provide for dynamic compensation, whereas the hydraulic main motor group is adapted to substantially take up the static load, which two motor groups are rotationally coupled to moving means, and a control unit which in response to input signals controls both motor groups, said main motor group having a stepwise and/or continuously variable displacement.

Hydraulic motors of variable displacement are well-known components within the field of hydraulics. Such motors have a controlling element which usually makes possible a continuous adjustment of the output power or torque in both directions of rotation. In an obvious and simple embodiment said main motor group thus consists of a single hydraulic motor of a type known per se and preferably having a continuously variable displacement.

In an alternative embodiment the main motor group may, however, consist of a number of hydraulic motors as known per se, having a fixed displacement, and being coupled together so as to act on a common output axle, and together being adapted to exert a smaller or larger torque when controlled by the control unit. In such case the control will involve the activation or coupling-in a smaller or larger number of these hydraulic motors depending upon the total torque which is desired. In a modification of this alternative embodiment there may be used in addition to the motors of fixed displacement, at least one hydraulic motor having a variable displacement, so that it will be possible to effect a combined stepwise and continuous regulation of the power. The coupling between a number of hydraulic motors as stated here, may for example take place by having gears on their output axles meshing with a larger gear or a spur ring on a common output axle.

In the following description the invention shall be explained more in detail with reference to the drawings in which.

Figure 1:
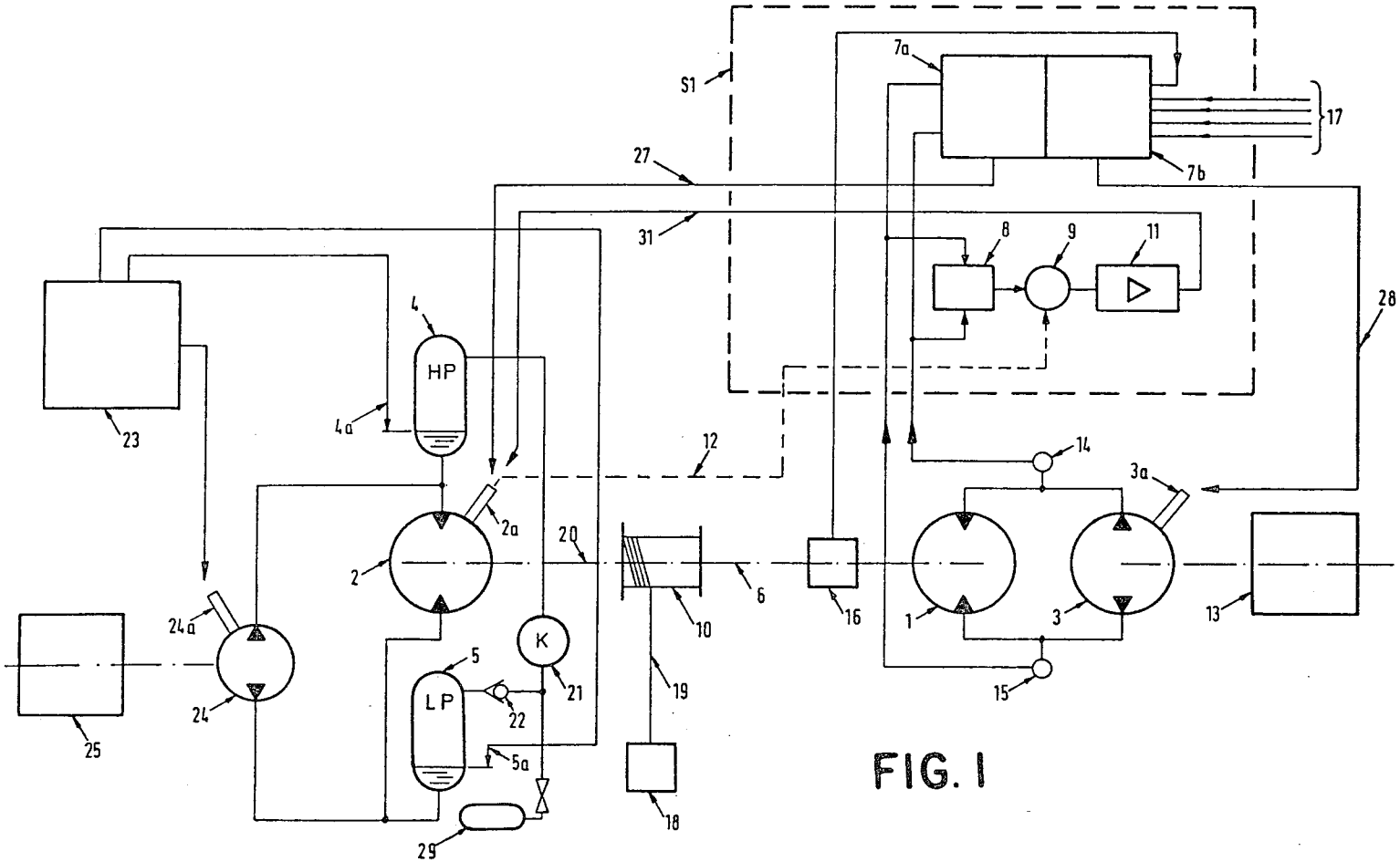
FIG. 1 illustrates diagrammatically a first compensating arrangement.

In FIG. 1 there is indicated a winch drum 10 which supports a load 18 suspended from a wire 19 which is in part wound on the drum 10. Through an axle 6 which may possibly include a gear transmission, the drum 10 is rotationally connected to a first hydraulic motor 1 with an associated hydraulic pump 3. The pump 3 is driven by a motor 13. This first motor 1 with the associated equipment may have comparatively moderate dimensions since it is adapted to give a small contribution to the dynamic compensation aimed at.

On the other side the drum 10 is rotationally coupled to another and more powerful hydraulic motor 2 through an axle indicated at 20 and which may also include a gear transmission. The hydraulic motor 2 is dimensioned in order to take up the total static load to which the drum 10 is subjected in the case of a suspended load 18. As will appear from the following description, however, the hydraulic motor 2 also plays a substantial role with respect to the dynamic compensation. This is made possible because this motor is of the type having a variable displacement. As already mentioned above, this variable displacement may also effectively be provided in an arrangement of several hydraulic motors of fixed displacement being adapted to be controlled selectively so that a stepwise regulation of the effective total displacement is obtained.

In addition of the two hydraulic motor groups 1 and 2 with associated equipment and auxiliaries which shall be explained more in detail below, the arrangement in the drawing comprises another main part in the form of a control unit S1 which on the basis of various input signals, delivers output signals to the first motor group and the second motor group respectively. Before explaining the operation of the control, the equipment being associated with the second hydraulic motor 2 shall be more closely described.

The motor 2 is driven by the pressure difference between two pressure containers 4 and 5 being so-called hydropneumatic pressure containers. As the motor 2 normally will perform an oscillating movement, it will alternately work as a motor and as a pump. As indicated the containers 4 and 5 contain an amount of hydraulic liquid and thereabove a normally larger gas compartment, for example filled with nitrogen or another suitable gas, as known from the field of hydraulics. According to the drawing the pressure container 4 is a high pressure container, whereas the container 5 has a low pressure, for example a pressure equal to the normal feed pressure for the hydraulic motor 2 when this works as a pump. At both containers there are shown level sensors 4*a* and 5*a* being connected to a level control circuit 23 adapted to actuate a control element 24*a* on a hydraulic pump 24 which is driven by a motor 25. The pump 24 thus will maintain an approximately constant level of hydraulic liquid in the containers 4 and 5. Leakage of hydraulic liquid may also have the consequence that the system will have a loss of such liquid, and supplementing liquid may then as known per se, be supplied to the system from the outside.

Corresponding to what has been described immediately above with respect to the hydraulic liquid, it is also necessary to maintain the pressure difference in the gas compartment of both containers 4 and 5. This is provided for by a compressor 21 which through a check valve 22 pumps gas from container 5 to container 4. If necessary, leakage of gas out of the system may be compensated for by connecting a supply tank 29 through a valve coupled to a point between the compressor 21 and the pressure container 5.

When considering more specifically the pressure difference between the containers 4 and 5, there is not shown any means for regulation thereof under operation. It is, however, primarily the control element 2*a* which determines the variable output power or the varying output torque from the motor 2. The maximum torque delivered thereby is determined by the maximum control angle of the element 2*a* and the above pressure difference between the containers 4 and 5. Regulation of the motor power by means of pressure variations in these containers is of no interest in the arrangement described here, because this involves a long time for building-up the necessary pressure difference between the pressure containers 4 and 5. It is just a point that this invention shall avoid complicated and expensive means for regulation by building-up and down respectively, the pressure difference between the containers 4 and 5.

An important input signal to the control unit S1 is obtained by an angle or position sensor 16 on the axle 6 between the drum 10 and the motor 1. This input signal is applied to a control circuit 7*a*/7*b* together with a number of other input signals, of which some are generally indicated at 17. These input signals may as previously known, comprise signals for desired lifting or lowering velocity of the load 18, a signal from an accelerometer on the top of a crane jib, and so on. The control circuit part 7*b* primarily has to do with the control of the first hydraulic motor 1 for dynamic compensation, which appears from the connection 28 for a control signal to a control element 3*a* on the hydraulic pump 3.

The control circuit part 7*a* is more particularly directed to the control of the second hydraulic motor 2, i.e. by actuating the control element 2*a* on the motor 2 through a wire 27. The input signals to the control unit which are most significant to this control by means of the control circuit part 7*a*, are derived from the pressure difference across the first hydraulic motor 1, i.e. the input pressure at 14 and the output pressure at 15 respectively, for this motor, or possibly vice versa at the opposite direction of rotation. The function of the complete control circuit 7*a*/7*b* in such a system is known per se among experts in the field of regulating systems and should not need any more detailed explanation here.

In parallel to or as an addition to the control circuit part 7*a*, there is, however, in the control unit S1 shown more in detail a control circuit comprising a comparator 8, a summation circuit 9 and an amplifier 11 the output signal of which through a wire 31 is also adapted to actuate the control element 2*a* on the motor 2. This first comparator 8 compares the pressures in the two indicated points 14 and 15 and the control of the control element 2*a* in principle takes place with the aim of bringing the pressure difference between points 14 and 15 as close to zero as possible. The summation circuit 9 is incorporated in an indicated feed-back from the control element 2*a* through the connection 12 as indicated. This forms a feed-back of a type known per se.

With an arrangement as described above the more powerful motor group 2 will to a substantial degree take over also the function as a dynamic compensation device so that the first hydraulic motor group 1 with associated pump 3 and drive motor 13, may have comparatively small dimensions or low capacity in relation to the maximum loads or disturbing forces to which the system is subjected.

In installations where the requirement as to an exact compensation is moderate, the motor group 1 may be deleted and the motor group 2 then takes over all the functions thereof. In this case the arrangement may be additionally simplified by deleting the comparator 8. In such case the control signal 28 acts together with or may be regarded as replaced by the control signal 27.

The second motor group 2 thus will exert a variable torque depending upon the control signals actuating the control element 2*a* such that this motor group to a substantial degree relieves the first and weaker motor group 1 whereby this latter will have a minimum of load or work to perform during the dynamic compensation process, or possibly the motor group 1 can be completely replaced by the second motor group 2. Thus, in this arrangement the motor group 2 will exert a constant force independently of position or angle, which represents a very advantageous fundamental solution obtained with simple and inexpensive means. In other words, the second motor group 2 controlled in this way may be regarded as constituting a spring device having a spring constant equal to zero. In the cases when the motor group 1 is deleted, the spring constant must be varied about the value zero, so that the magnitude and direction thereof give the necessary motive forces for the compensation movement. This shows clearly that the arrangement according to the invention may have many uses in addition to the above examples, when movement compensation is concerned in systems where large masses or loads are involved.

Finally, it is remarked that the control unit S1 with the control circuits discussed, may obviously be adapted to carry out their control functions with a predictive effect according to principles being well-known within the field of regulating systems.

The following description relates to a further development or modification of the arrangement described above, which modification involves advantages inter alia by eliminating mechanical transmission components which according to the circumstances, would be apt to give rise to problems. Moreover, the present modification has advantages thereby that in principle it is independent of the main machinery in hoists, cranes, etc., so that these to a large extent will be able to perform their function even if the compensation arrangement for some reason or other should be made inoperative. In connection therewith this further developed or modified compensation arrangement avoids large rotating masses, which may be included for example in winch drums for large cranes and hoists. An additional advantage consists therein that the arrangement can easily be adopted for load situations in which the force has an alternating direction, in particular where the load does not necessarily hang from a flexible element such as a wire or the like. An example of a practical use which is directly made possible by the modification described here, is the movement compensation of helicopter platforms on ships and other floating installations.

This development or modification of the invention shall be explained more closely in the following with reference to the drawing (FIG. 2) which in a much simplified and schematic form shows an embodiment according to this aspect of the invention.

Figure 2:
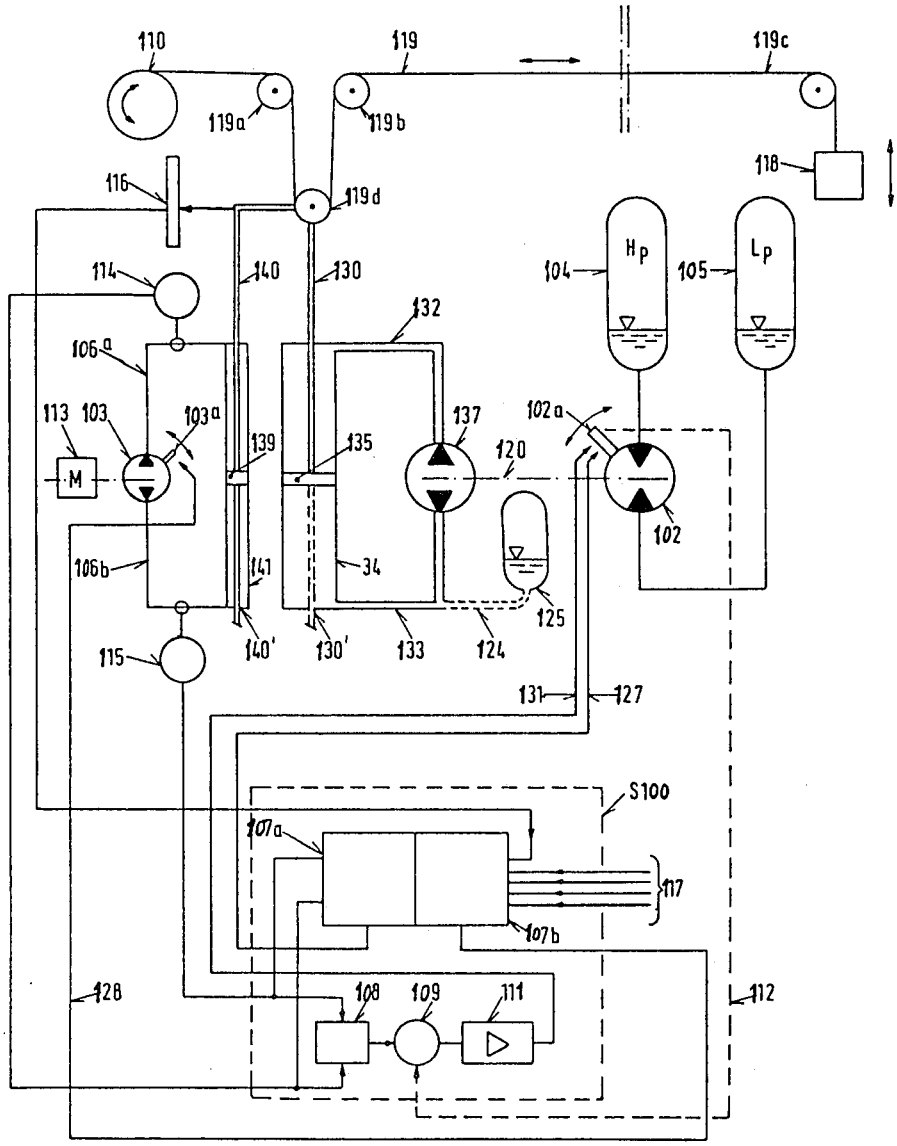
FIG. 2 illustrates diagrammatically a second compensating arrangement.

In FIG. 2 there is in the upper left part indicated a winch drum 110 which supports a load 118 suspended from a wire 119 which is in part wound on the drum 110. The wire 119 runs over sheaves 119*a*, 119*b*, 119*c* and 119*d* of which the latter forms a movable element in the modified compensation arrangement to be described here.

It is assumed that the winch drum 110 is included in the main machinery of a large crane, hoist or the like and is coupled to drive means which can be of a conventional type not in need of any closer explanation here.

In this embodiment the compensation arrangement is divided into two sections for mainly dynamic compensation and static compensation respectively. For the substantially dynamic compensation there is provided a hydraulic pump 103 driven by a motor 113 and having output conduits 106*a* and 106*b* which lead to opposite ends of a hydraulic cylinder 141. The cylinder 141 is provided with a piston 139 with a through-going piston rod 140-140', of which the former is mechanically coupled to the sheave 119*d*. The pump 103 with associated equipment may have comparatively moderate dimensions since it is adapted to give a comparatively small contribution to the dynamic compensation aimed at.

The other section which as a starting point shall take up the static load on the compensation arrangement, comprises a powerful combination of a hydraulic motor 102 and a pump 137 which is dimensioned to take up the complete static load which is due to the suspended load 118. As will appear from the following, the hydraulic motor 102 also plays a substantial part as far as the dynamic compensation is concerned, this being in a way corresponding in principle to the function of the second or main hydraulic motor 2 described above in connection with the first embodiment shown in FIG. 1 of the drawings.

Through an axle 120 the motor 102 drives a second pump 137 the output conduits 132 and 133 of which are connected to opposite ends of a second hydraulic cylinder 134. An upward piston rod 130 from a piston 135 is directly coupled to the sheave 119*d* in order to keep or move the same in desired positions.

In the system consisting of pump 137 and cylinder 134 when the piston rod 130 is extending only at one side, it is necessary to have a volume compensation, which is provided for by an auxiliary container 125 which is connected to conduit 133 through a conduit 124. This auxiliary container 125 can be omitted, however, in the case when the piston 135 has a through-going or double-ended piston rod as shown with the extension 130' in dotted lines downward from piston 135.

With the parallel arrangement of cylinders 134 and 141 the pistons therein will, because of the mechanical coupling at the sheave 119*d*, move simultaneously up and down during compensation operations. The indicated sub-division into two such sections may in the case of more moderate requirements as to accuracy in the compensation, be combined or integrated into one section, wherein a single cylinder with associated hydraulic pump can take over the complete function both with respect to dynamic compensation and static load. The powerful hydraulic motor 102 will then be used as the driving source of power.

In addition to the two hydraulic-mechanical units or sections and associated auxiliary equipment as mentioned above and to be explained more closely below, the arrangement in FIG. 2 comprises another main part in the form of a control unit S100 which on the basis of various input signals delivers control signals to the respective motors and pumps. This control unit performs functions much corresponding to those performed by the above control unit S1 (FIG. 1). Before further explanation is given regarding control unit S100, the equipment associated with the hydraulic motor 102 shall be summarized.

Motor 102 has a function being very similar to the function of motor 2 in the embodiment of FIG. 1. Thus, components and elements in FIG. 2 corresponding to components and elements in FIG. 1, have a reference numeral obtained by adding one hundred to the respective reference numerals in FIG. 1.

As to the problems of liquid leakage and necessary supplementary supply of gas, similar equipment as described with reference to FIG. 1, may also be present in the arrangement of FIG. 2. Whereas in the embodiment of FIG. 1 an important input signal to control unit S1 is obtained by an angle or position sensor 16 on axle 6, a correspondingly important input signal to control unit S100 is obtained from a distance or position sensor 116 provided at the piston rod 140. This input signal is applied to control circuit 107*a*, 107*b* together with a number of other input signals of which some are shown generally at 117. The function and signal processing taking place in the control unit is here quite analogous to what is found in control unit S1 and does not seem to require further explanation here. However, instead of the first hydraulic motor 1 referred to in the embodiment of FIG. 1, the first hydraulic pump 103 should be considered in the present embodiment.

In the above alternative embodiment in which the motor 102, the pump 137 and the cylinder 134 take over all functions from the section which initially should provide for the dynamic compensation, the practical design may be additionally simplified by omitting the comparator 108. In such case the control signal 128 acts together with or can be regarded as replaced by the control signal 127.

Figure 3:
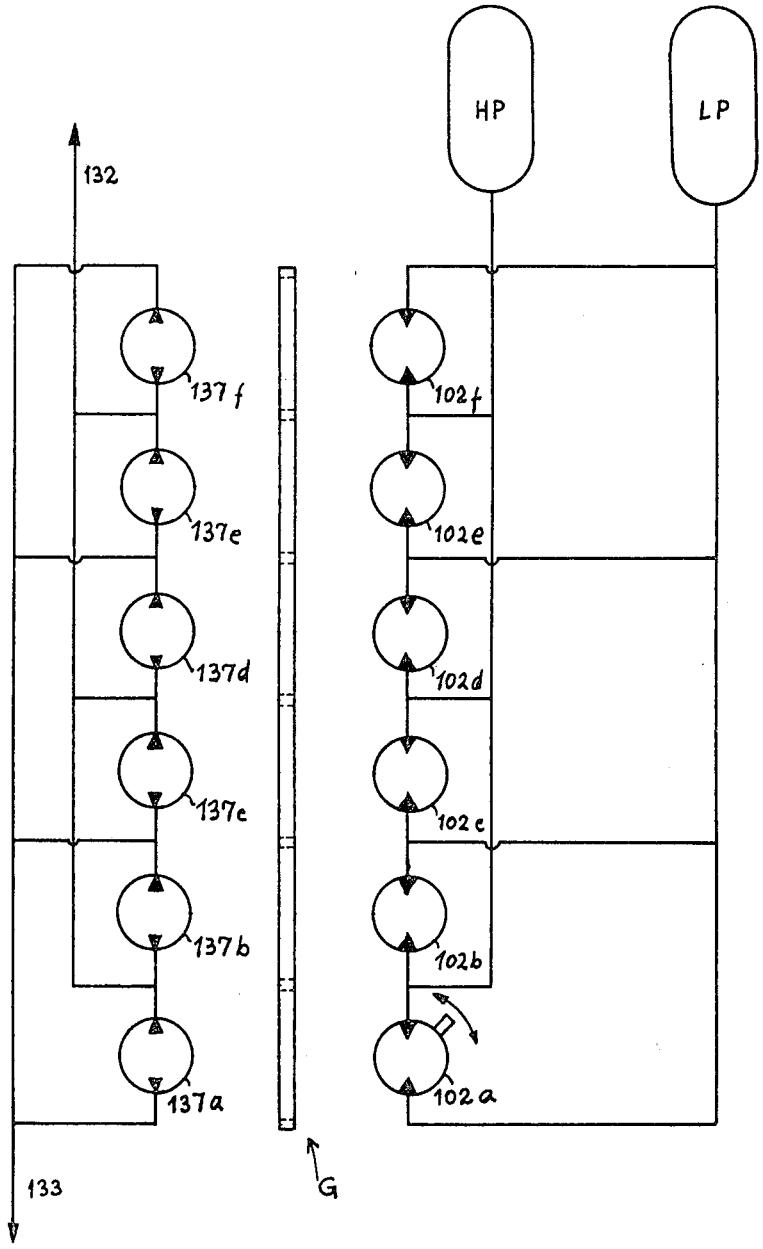
FIG. 3 illustrates a modification of the arrangement shown in FIG. 2.

As mentioned above, the embodiment of FIG. 2 involves inter alia the advantage that mechanical transmission components which may lead to problems, are eliminated. This relates to the fact that with the large amount of power which may be involved in such compensation arrangements, it will be suitable with respect to technical and economical considerations to use standard components as a basis for the hydraulic motors and the hydraulic pumps respectively. It may then be necessary to connect a number of such components in parallel in order to obtain the desired power rating. In the present case this particularly applies to the hydraulic motor or motor group 102 with the associated pump or pump group 137. In connection with the arrangement described here this assembly can be composed as shown in FIG. 3 of a number of pairs of cooperating motors 102*a*–102*f* and pumps 137*a*–137*f* coupled together so as to act on a common output axle (not shown) and which through a manifold in front of the motor are driven by the pressure containers 104 and 105, whereas a corresponding manifold at the output of the pumps collects the total hydraulic power therefrom to the respective conduits 132 and 133 which lead to the cylinder 134. The motor 102*a* is of variable displacement, whereas the motors 102*b*–102*f* are of fixed displacement. This form of coupling or parallel operation of the hydraulic motors and pumps respectively, obviously in the application of interest here is much more reliable and flexible than a pure mechanical transmission for example with a number of parallel motors operating on a common gear. Moreover, the friction losses will be lowered.

As in the embodiment of FIG. 1, the control unit in the embodiment of FIG. 2 with control circuits may be adapted to perform their control functions with a predictive effect according to well-known regulating system principles.

I claim:

1. An arrangement for compensating for undesired movements of a load relative to a station, comprising an element which is adapted to be coupled to the load by a force-transmitting member and is mounted on the station so as to be movable with respect thereto; first and second hydropneumatic pressure containers, and a main hydraulic machine of variable displacement and operable both as a motor and as a pump and connected to the containers so that in its motor mode of operation it is driven by flow of fluid under pressure from the first container to the second container and in its pump mode of operation it pumps fluid from the second container into the first container, means which couple drivingly the hydraulic machine and the movable element for moving the movable element so as to maintain control of the force exerted on the element by the load through the force-transmitting member upon movement of the load; an auxiliary hydraulic machine including a motor device which is coupled drivingly to the movable element and a pump device which is in fluid communication with the motor device, the pump device having a variable power output; a load position sensor and a control unit connected to the hydraulic machines for controlling the displacement of the hydraulic machines in response to input signals received thereby from the hydraulic machines and from the load position sensor, and the control unit being also connected to the pump device for controlling the power output therefrom, one input signal to the control unit being representative of the pressure difference across said pump device; and the main hydraulic machine in operation provides static compensation whereby the pump device and motor device provide dynamic compensation and thereby obtain a controlled position of the load.

2. An arrangement according to claim 1, wherein said hydraulic machine has a continuously variable displacement and means for effecting same.

3. An arrangement according to claim 1, wherein said hydraulic machine comprises a plurality of hydraulic devices each of fixed displacement, so that the total displacement of the hydraulic machine is variable by varying the number of devices which are operative.

4. An arrangement according to claim 1, wherein the hydraulic machine comprises a plurality of hydrualic devices each of fixed displacement, and at least one hydraulic device of variable displacement.

5. An arrangement according to claim 4, wherein said device of variable displacement has a continuously variable displacement.

6. An arrangement according to claim 1, wherein said hydraulic machine comprises a plurality of hydraulic motors each of fixed displacement and a like plurality of hydraulic pumps coupled mechanically to the motors respectively, said motors being provided with manifold means for connection to the pressure containers.

7. An arrangement according to claim 1, wherein the control unit controls the displacement of the hydraulic machine in such a manner as to minimize said pressure difference.

8. An arrangement according to claim 1, wherein the hydraulic machine has a control member for adjusting the displacement thereof, and the control unit includes comparator means for developing a signal representative of the pressure difference across said pump device and employing said signal to actuate said control member.

9. An arrangement according to claim 8, comprising means for developing a feedback signal representative of the displacement of said hydraulic machine and combining it with the signal representative of said pressure difference.

10. An arrangement according to claim 1, further comprising a compressor and a check valve connected to maintain pressure difference between the pressure containers.

11. An arrangement according to claim 10, comprising a gas tank and a valve for connecting the gas tank to the second container to introduce replenishing gas into the second container.

12. An arrangement according to claim 1, wherein said hydraulic machine has an axle which is directly connected mechanically to said movable element.

* * * * *